US009481013B2

(12) United States Patent
Anderson

(10) Patent No.: US 9,481,013 B2
(45) Date of Patent: Nov. 1, 2016

(54) COMBINED AUGER AND SCREENING APPARATUS FOR SCREENING AND CONVEYANCE OF GRANULAR FERTILIZER OR THE LIKE

(71) Applicant: Neil Anderson, Hazlet (CA)

(72) Inventor: Neil Anderson, Hazlet (CA)

( * ) Notice: Subject to any disclaimer, the term of this patent is extended or adjusted under 35 U.S.C. 154(b) by 3 days.

(21) Appl. No.: 14/542,226

(22) Filed: Nov. 14, 2014

(65) Prior Publication Data

US 2015/0129468 A1 May 14, 2015

Related U.S. Application Data

(60) Provisional application No. 61/904,144, filed on Nov. 14, 2013.

(51) Int. Cl.

| | |
|---|---|
| ***B07B 1/42*** | (2006.01) |
| ***B07B 1/00*** | (2006.01) |
| ***B07B 1/30*** | (2006.01) |

(52) U.S. Cl.

CPC ..... *B07B 1/005* (2013.01); *B07B 1/30* (2013.01); *B07B 1/42* (2013.01); *Y10T 29/49716* (2015.01)

(58) Field of Classification Search

CPC ..... B07B 1/005; B07B 1/28; B07B 1/42; B07B 1/46; B07B 15/00; B07B 2201/02

See application file for complete search history.

(56) References Cited

U.S. PATENT DOCUMENTS

| | | | | |
|---|---|---|---|---|
| 2,706,046 A | | 4/1955 | Andrews | |
| 3,411,757 A | | 11/1968 | Hale | |
| 3,532,276 A | | 10/1970 | Dunn | |
| 3,610,414 A | | 10/1971 | Zumalt | |
| 3,928,189 A | * | 12/1975 | Lower | B07B 1/48 209/319 |
| 4,095,705 A | | 6/1978 | Hood | |
| 4,684,458 A | | 8/1987 | Grotto | |
| 5,655,872 A | * | 8/1997 | Plotkin | B60P 1/40 198/313 |
| 5,921,401 A | * | 7/1999 | Johnston | B07B 1/005 209/311 |
| 6,029,822 A | * | 2/2000 | Skoropa | B07B 1/34 209/325 |
| 6,520,458 B2 | * | 2/2003 | Podoll | E01C 19/20 222/180 |
| 6,669,026 B2 | * | 12/2003 | Cohen | B07B 1/005 209/366.5 |
| 7,344,637 B2 | * | 3/2008 | Frommann | B01D 33/067 210/158 |
| 7,785,866 B2 | * | 8/2010 | Winslow | C05F 17/0018 435/290.2 |
| 8,091,711 B2 | * | 1/2012 | Hsiau | B07B 1/22 209/284 |
| 9,022,687 B2 | * | 5/2015 | Smith | E02F 7/06 405/80 |
| 9,242,792 B2 | * | 1/2016 | Babcock | B65D 88/32 |

* cited by examiner

*Primary Examiner* — Joseph C Rodriguez

(74) *Attorney, Agent, or Firm* — Kyle R. Satterthwaite; Ryan W. Dupuis; Ade & Company Inc.

(57) ABSTRACT

A combined auger conveyor and screening apparatus features an inlet hopper mounted to an auger housing adjacent an inlet end thereof, and a screen support frame disposed atop the inlet hopper and supporting a screen over an area of the inlet hopper. A screen drive mechanism is removably mounted to the auger housing, coupled to the screen support frame and operable to drive oscillatory motion of the screen. An angle adjustment mechanism is operable to vary a position of ground wheels relative to the auger housing in order to change an inclination angle of the auger housing and screen relative to the ground. A hydraulic circuit supplying hydraulic motors for both the auger and the screen drive mechanism comprises a control valve operable to adjust an oscillatory speed of the screen support frame.

25 Claims, 13 Drawing Sheets

COMBINED AUGER AND SCREENING APPARATUS FOR SCREENING AND CONVEYANCE OF GRANULAR FERTILIZER OR THE LIKE

CROSS REFERENCE TO RELATED APPLICATIONS

This application claims benefit under 35 U.S.C. 119(e) of Provisional Application Ser. No. 61/904,144, filed Nov. 14, 2013.

FIELD OF THE INVENTION

The present invention relates generally to conveyors, and more particularly to an auger unit featuring a built in screening mechanism for screening of material before it enters the auger, for example for use in unloading granular fertilizer from a storage bin in an agricultural setting.

BACKGROUND OF THE INVENTION

The present application discloses a transfer auger that screens/scalps foreign material out of granular fertilizer as it transfers from the storage bin to the seeding/fertilizing equipment subsequently used to apply the fertilizer in the field. This is a problem that "EVERY" farmer in the world encounters.

Granular fertilizer has been known to contain contaminants in the form of hardened clumps of fertilizer, stones, wood, bucket elevator bolts and other objects that don't belong in the desired fertilizer product to be applied to agricultural fields. If these contaminants enter the seeding equipment they can cause plugging, metering roller damage and misapplication of products, and can result in the cost of large repair bills and/or potential revenue loss.

To Applicant's knowledge, there is no other device in the market that is designed to screen fertilizer as it leaves a storage bin.

A previously marketed solution is a hydraulic unit called the Lump Buster, by Rainy Day Fabricating Inc., which installs on the end of an auger to "grind" the fertilizer as it passes through, but such a solution does not address the issue of the removal of other contaminants that may be present in the fertilizer, and may also create fertilizer dust, which can attract moisture and cause additional problems.

U.S. Pat. No. 4,095,705 proposes use of a combined auger and screening apparatus for loading of prilled fertilizer into an aircraft for aerial application of fertilizer to the field. An inlet hopper features a screen recessed into the open top end of the hopper and is supported on a wheeled frame shared by an auger conveyor that slopes upwardly from the underside of the hopper to an outlet end of the auger housing. A belt-driven system is operable to drive the auger shaft via an input pulley of the auger than carries an eccentric mass so as to cause a vibrational effect on the hopper to prevent bridging and tunneling of material therein.

Other devices for screening granular fertilizer are disclosed in U.S. Pat. Nos. 3,532,276 and 3,610,414, but these are not intended for use in transferring fertilizer from a storage bin to application equipment in a farm setting, and accordingly lack portability and an inclined conveyor operable to elevate material from the bottom outlet of a hopper bin into an air seeder or drill.

U.S. Pat. No. 3,411,757 discloses a loader for precision mixing of cement and features an auger whose inlet hopper features an input screen for filtering out of larger particles to prevent entry thereof to the auger inlet, but no vibrational mechanism is included to achieve optimum filtering through this screen.

Other known auger designs with built-in screening means include grain-screening augers, such as those disclosed in U.S. Pat. Nos. 2,706,046 and 4,684,458, but such designs employ screens that are incorporated into the auger tube, and accordingly only filter out unwanted material after it has already entered the auger tube. Stand alone grain cleaners are also known, but are not suitable for use in screening of granular fertilizer.

Applicant has developed a unique apparatus that combines screening and conveying functionality into a single unit in a manner not seen nor suggested by the prior art, and that may be used for the loading of granular fertilizer application equipment from a storage bin, or other similar contexts that may also require combined screening and conveyance functionality.

SUMMARY OF THE INVENTION

According to a first aspect of the invention there is provided a combined conveyor and screening apparatus comprising:

a housing having opposing inlet and outlet ends spaced apart along a longitudinal dimension of the housing;

a conveyor residing in a position running longitudinally of the housing between the inlet and outlet ends thereof;

an inlet hopper mounted to the housing adjacent the inlet end thereof with an open lower end of the inlet hopper opening into the housing for feeding of the conveyor from said inlet hopper;

a screen;

a screen support frame disposed atop the inlet hopper, the screen support frame supporting, or being arranged to support, the screen in a position overlying an area of the inlet hopper; and a screen drive mechanism coupled to, or arranged for coupling to, the screen support frame and operable to drive oscillatory motion of the screen support frame relative to the inlet hopper and the housing.

According to a second aspect of the invention there is provided a combined conveyor and screening apparatus comprising:

an housing having opposing inlet and outlet ends spaced apart along a longitudinal dimension of the housing;

a conveyor running longitudinally of the housing between the inlet and outlet ends thereof;

an inlet hopper mounted to the housing adjacent the inlet end thereof with an open lower end of the inlet hopper opening into the housing for feeding of the conveyor from said inlet hopper;

a screen carried on the housing and positioned to screen incoming material introduced into the housing through the inlet hopper;

a ground wheel assembly coupled to the housing and comprising a set of ground wheels for rolling transport of the housing over a ground surface; and an angle adjustment mechanism is operable to vary a position of the ground wheels relative to the housing in order to change an inclination angle of the housing and the screen relative to the ground surface on which the housing is supported.

According to a third aspect of the invention there is provided a combined conveyor and screening apparatus comprising:

a housing having opposing inlet and outlet ends spaced apart along a longitudinal dimension of the housing;

a conveyor running longitudinally of the housing between the inlet and outlet ends thereof;

an inlet hopper mounted to the housing adjacent the inlet end thereof with an open lower end of the inlet hopper opening into the housing for feeding of the conveyor from said inlet hopper;

a screen unit carried on the housing and comprising a screen positioned to screen incoming material introduced into the housing through the inlet hopper;

a first hydraulic motor operable to drive oscillatory motion of the screen unit relative to the inlet hopper and the housing;

a second hydraulic motor operably coupled to the conveyor for driven operation thereof;

a hydraulic circuit coupled to the first and second hydraulic motors and arranged for powering of both thereof by a common hydraulic power source;

wherein the hydraulic circuit comprises a control valve operable to adjust an oscillatory speed of the screen support frame.

According to a fourth aspect of the invention, there is provided a kit for outfitting a conveyor with a screening arrangement, the kit comprising:

a screen;

a screen support frame mountable to an inlet hopper of the conveyor and arranged for support of the screen in a position overlying an area of the inlet hopper; and a screen drive mechanism mountable to a frame or housing of the conveyor and coupled, or arranged for coupling, to the screen support frame and operable to drive oscillatory motion of the screen support frame relative to the inlet hopper and the housing of the conveyor.

According to a fifth aspect of the invention, there is provided A method for outfitting a conveyor with a screening arrangement, the method comprising:

(a) removing a releasably mounted screen drive mechanism from a first frame or housing of a first conveyor that has a first inlet hopper with a first screen support frame mounted thereon;

(b) releasably mounting the screen drive mechanism on a second frame or housing of a second conveyor that has a second inlet hopper with a second screen support frame mounted thereon; and (c) coupling the screen drive mechanism to the second screen support frame, whereupon the screen drive mechanism is operable to drive oscillatory motion of the second screen support frame relative to the second inlet hopper and the second housing of the second conveyor.

BRIEF DESCRIPTION OF THE DRAWINGS

In the accompanying drawings, which illustrate a exemplary embodiments of the present invention.

DETAILED DESCRIPTION

Figure 1:
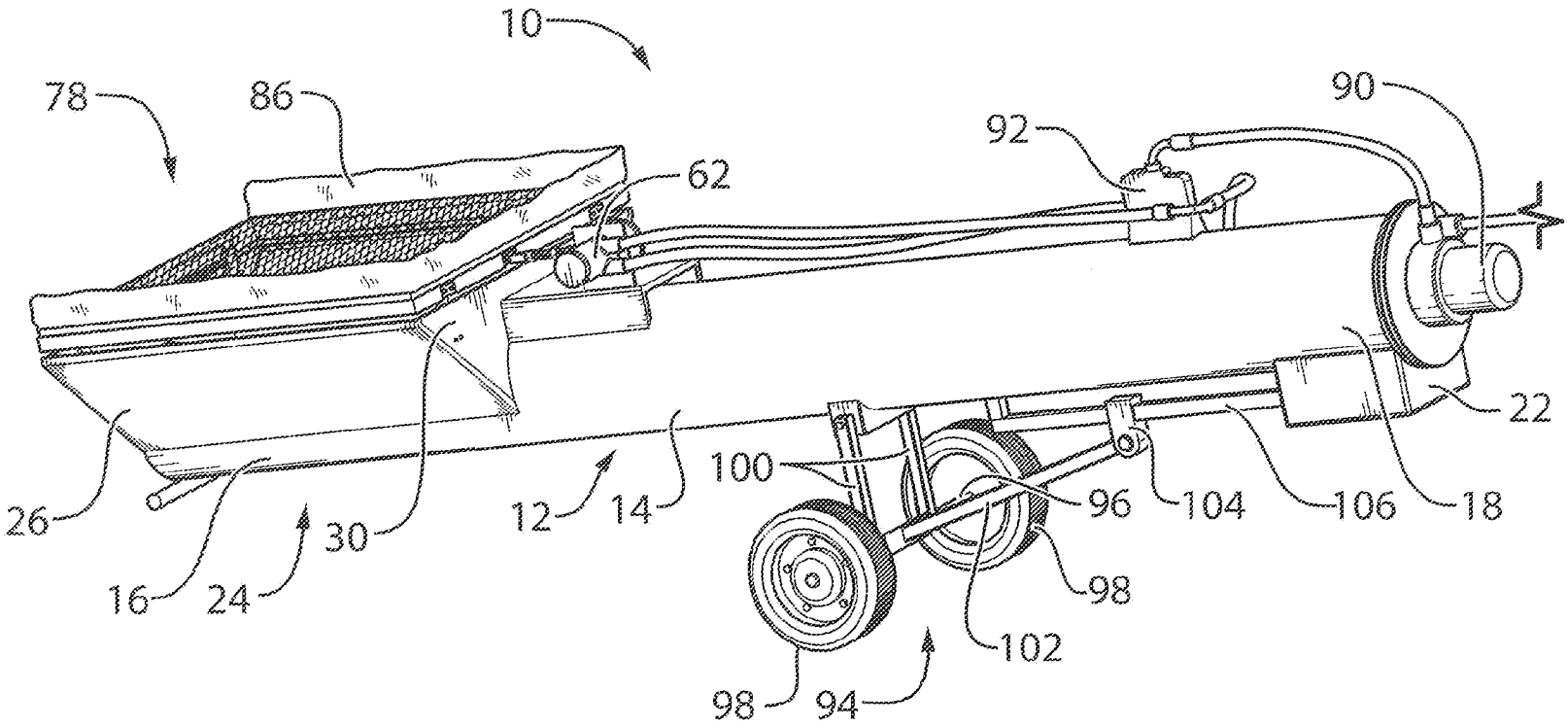
FIG. 1 is a side perspective view of a combined auger conveyor and screening apparatus according to a first embodiment of the present invention.

FIG. 1 shows a first embodiment of a combined screening and conveying apparatus for screening and conveying granular fertilizer or other granular or particulate material. The apparatus 10 features an elongated auger housing 12 of conventional shape featuring a tubular cylindrical portion 14 running along a longitudinal axis between an inlet portion 16 at one end of the housing and an outlet portion 18 at an opposing end of the housing. At the inlet portion 16, a topside of the housing features a cutout or opening 20 that defines an inlet by which material is introducible into the interior of the housing from above. At the outlet portion 18, an underside of the housing features a cutout or opening that defines and outlet through which material is discharged from the housing. As shown, a discharge chute or shroud 22 may be provided around the outlet opening to guide the discharged material directly downward from the outlet opening to focus the discharge and minimize lateral spread of the discharged material outward to the sides of the housing.

At the inlet end portion 16 of the auger housing, an inlet hopper 24 is fixed atop the auger housing around the inlet opening 20 therein so that a bottom of the inlet hopper's interior opens into the auger housing at the topside inlet opening 20 thereof. Rectangular side walls 26, 28 of the inlet hopper 24 diverge upwardly away from one another and flare laterally outward relative to the longitudinal axis of the auger housing so that the open top end of the inlet hopper has a greater area than the open bottom end thereof that directly overlies, and feeds into, the inlet end portion of the auger housing. In the illustrated embodiment, the inlet hopper features four flat walls, of which two opposing parallel end walls 30, 32 of the hopper lie in respective planes that are perpendicular to the longitudinal axis of the auger housing. Other embodiments may depart from this shape of hopper, and for example feature end walls that diverge upwardly away from one another so that the hopper tapers not only in width, but also in length.

In a conventional manner, an auger 36 is rotatably mounted in the auger housing so that the auger shaft 38 lies on the central longitudinal axis of the housing's interior and is rotatable about this axis, whereby helical flighting 40 fixed to the auger shaft 40 is operable to convey granular material from the inlet end portion of the auger housing to the opposing outlet end portion thereof under driven rotation of the auger shaft in a predetermined direction. The auger can also be driven in the reverse direction to convey material in the auger housing toward the inlet end portion thereof, for example for cleanout purposes. It will be appreciated that the forgoing description outlines an auger housing, inlet hopper and auger of generally conventional form. Attention is now turned to additional features of the apparatus that set it apart from the prior art.

Figure 3:
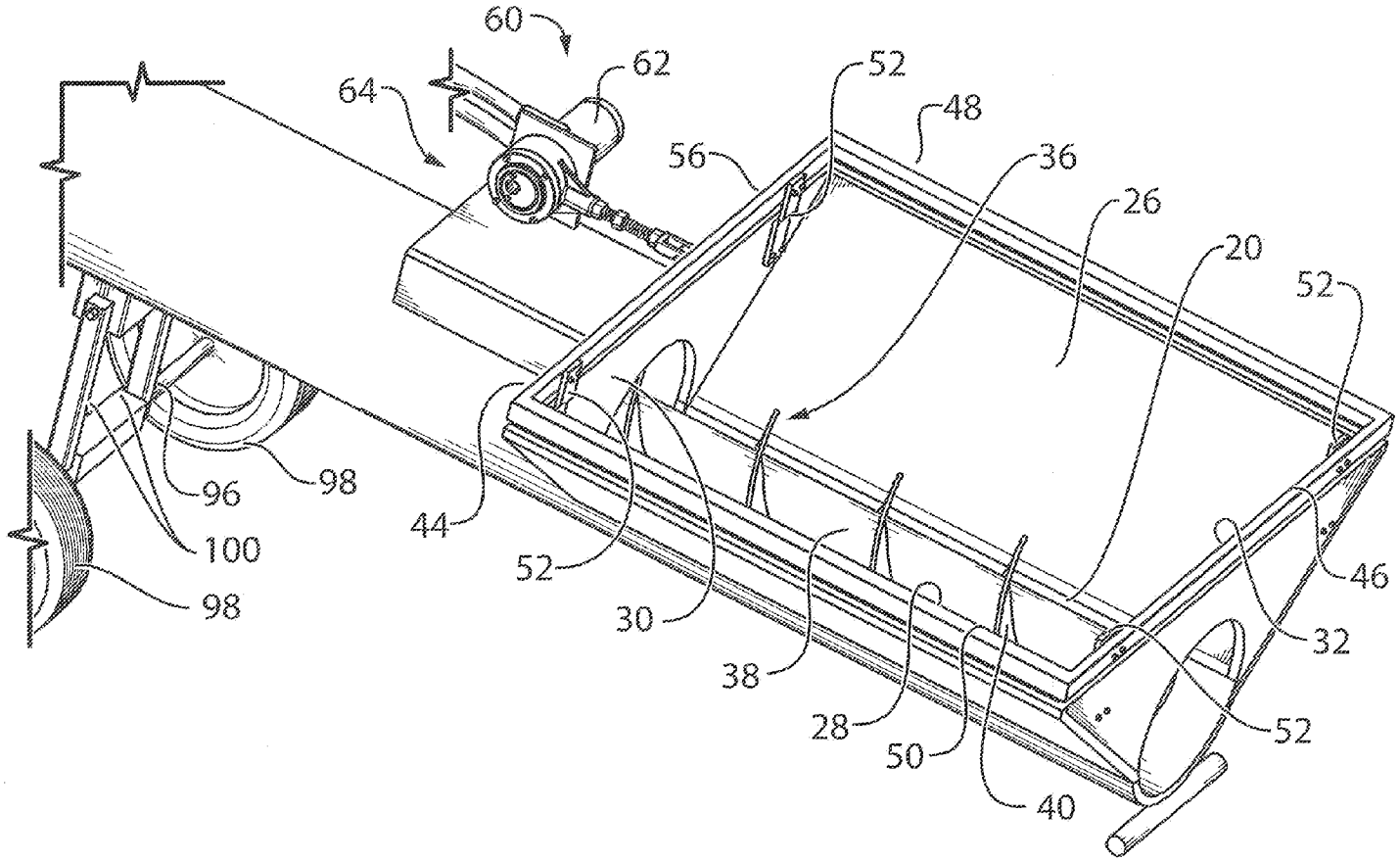
FIG. 3 is another partial overhead perspective view similar to FIG. 2, but with the screening unit removed to show details of the support frame, inlet hopper and auger of the apparatus.
Figure 4:
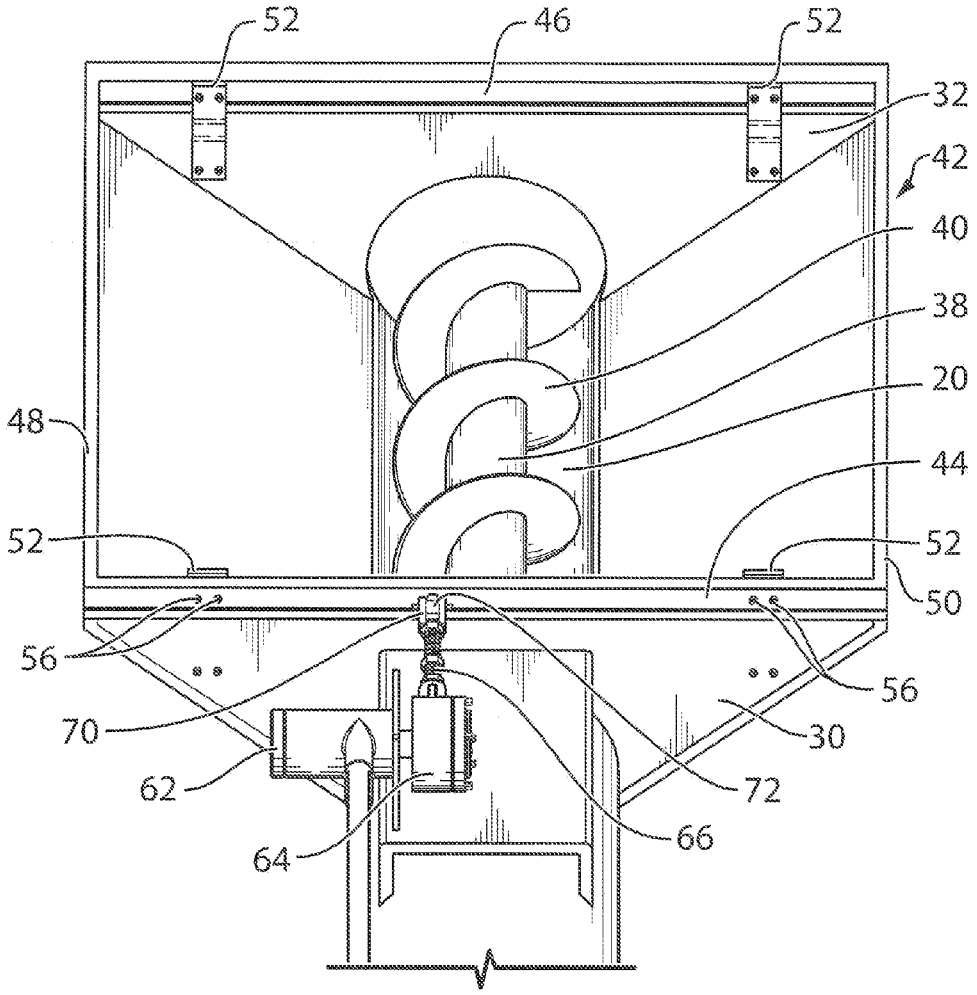
FIG. 4 is another partial perspective view of the apparatus of FIG. 3, but from another angle.

As best shown in FIGS. 3 and 4, a screen support frame 42 overlies the perimeter of the open top end of the inlet hopper 24. In the illustrated embodiment, where the four-walled inlet hopper has a rectangular perimeter at its upper end, the screen support frame 42 is of rectangular form, being made up of four pieces of rectangular metal tubing connected end-to-end to form a rectangular frame, whereby each piece of tubing forms a respective perimeter member of the support frame that overlies a respective perimeter edge of the top end of the inlet hopper. Two end perimeter members 44, 46 of the support frame are spaced apart along the longitudinal axis of the auger housing and lie perpendicular thereto, while the two remaining side perimeter members 48, 50 of the support frame lie parallel to the longitudinal axis and are spaced apart laterally across the same. Each of the two end perimeter members 44, 46 is connected to a respective one of the inlet hopper end walls 30, 32 by a pair of bent connection plates 52 whose upper ends are attached to the end perimeter member and whose bottom ends are attached to the respective hopper end wall. In the illustrated embodiment, bolts 56 are used to attach the bent plates to both the support frame and inlet hopper, but other embodiments may employ other fastening means, such as welding.

The connection plates 52 are strip shaped, thus each having a length that exceeds its width, which in turn exceeds its thickness. Each plate is oriented so that its length extends upward along the plane of the respective hopper end wall, its width is measured laterally along this plane, and the plate thickness is measured generally normal to this plane, i.e. generally parallel to the longitudinal axis of the auger housing. Each plate is flexible to allow bending thereof about a transverse axis that lies in the width direction of the plate, whereby the top end of each plate can deflect back and forth along the longitudinal axis of the auger housing relative to the lower end of the plate that is attached to the hopper wall. Each plate thus forms a flexible or deflectable member that connects the support frame to the inlet hopper, thereby preventing separation of these two components, while allowing back and forth movement of the support frame relative to the inlet hopper in the longitudinal direction.

Other arrangements for carrying the support frame in a manner displaceable back and forth along the plane of the open top end of the hopper may alternatively be used, as described herein further below with reference to the embodiment of FIG. 12. In the first embodiment, each connection plate 52 is mounted to the inlet hopper at the interior thereof, and the connection plate 52 bends inwardly away from a flat end portion that is flush mounted against the hopper wall. As a result, the upper end of the plate that is flush mounted against the inner side of the end perimeter member of the support frame is located a short distance inwardly toward the center of the inlet hopper from the end wall thereof. This way, a range of motion of the support frame can be accommodated in either direction along the longitudinal axis without the end walls of the hopper blocking the deflection of the connection plates 52 that is required for such movement.

Mounted atop the tubular section 14 of the auger housing 12 at a location between the inlet hopper and the outlet end of the auger housing, an oscillatory drive mechanism 60 features a hydraulic motor 62 whose output shaft rotatably drives an eccentric bearing assembly 64. An output arm 66 of the eccentric bearing assembly 64 reaches longitudinally over the topside of the auger housing toward the inlet hopper. The distal end of the output arm furthest from the rotational axis of the motor's output shaft is pivotally coupled to the nearest end member 44 of the support frame 42, for example by a bolt or pin 68 passing through aligned holes in a bifurcated end portion 70 of the support arm and a corresponding lug 72 that is fixed to the outer side of the end member 44. The bolt or pin 68 defines a transverse pivot axis that is parallel to the rotational axis of the hydraulic motor 62 and perpendicular to the longitudinal axis of the auger housing.

The eccentric bearing assembly 64 features an inner race 74 that is coupled to the output shaft of the motor 62 in an eccentric position relative thereto. The eccentric bearing assembly 64 also features an outer race 76 to which the proximal end of the output arm 66 is attached. Accordingly, under operation of the motor to drive its output shaft, the inner race rotates eccentrically about the motor's output shaft, which causes the outer race to move in a manner causing the output arm to oscillate between an extended position, in which the output arm's distal end reaches a furthest possible distance from the motor's rotational axis toward the inlet end of the auger housing, and a retracted position, in which the output arm's distal end is its nearest position to the motor's output axis and the output end of the auger housing.

With the distal end of the output arm coupled to the nearest end member 44 of the support frame 42, this oscillating motion of the output arm causes the support frame to oscillate back and forth along the longitudinal dimension of the auger housing at the upper perimeter of the inlet hopper. Accordingly, when a screening unit is installed atop the support frame, as described below, the screening unit will likewise oscillate back and forth over top of the inlet hopper to provide an effective screening action to material fed onto a screen of the unit. This can be used in order to screen out large fertilizer clumps or other unwanted constituents of the material dumped onto the screen before entry of the remaining material into the inlet hopper through the openings or apertures in the screen.

Figure 2:
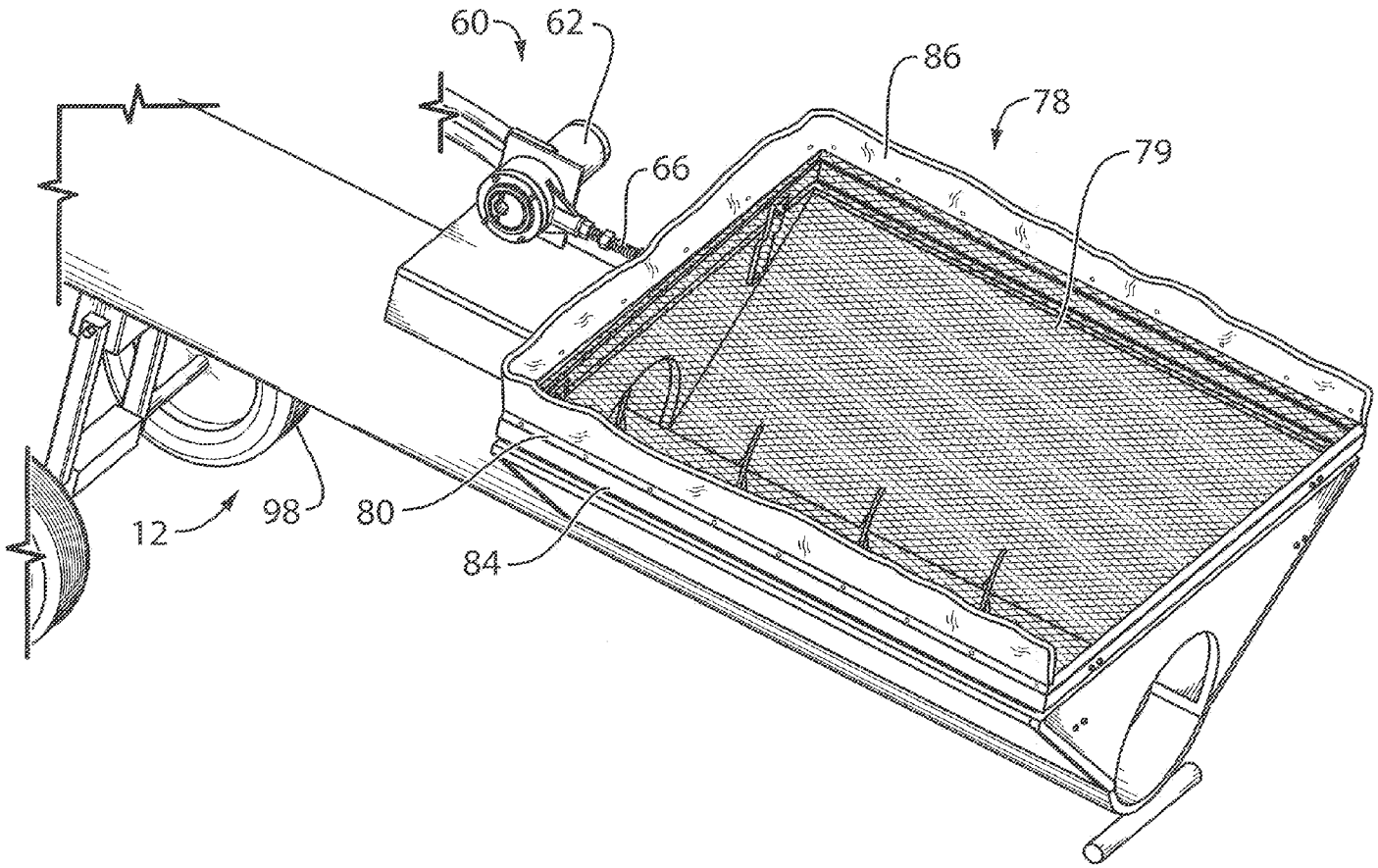
FIG. 2 is a partial overhead perspective view of the apparatus of FIG. 1, showing a removable screening unit seated in an operational position on a support frame situated atop an inlet hopper of the apparatus.
Figure 5:
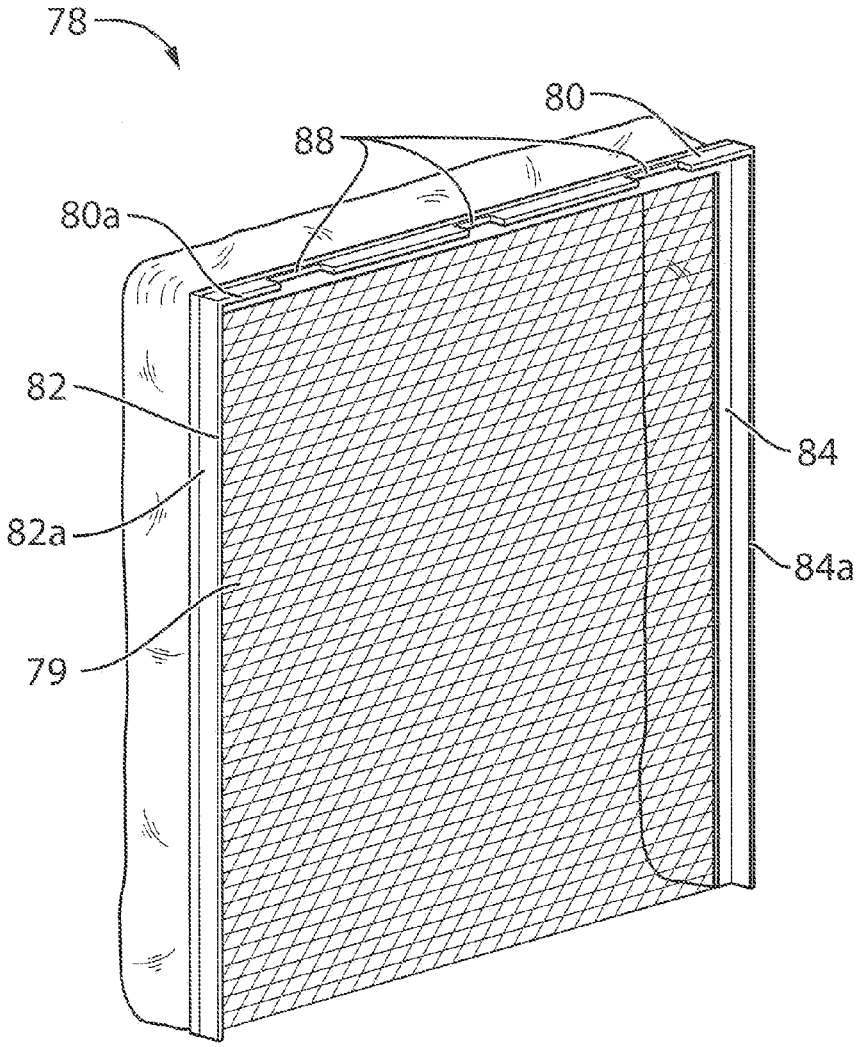
FIG. 5 shows the screening unit from an underside thereof that sits atop the support frame when the screening unit is placed in the operational position for use of the apparatus in a screening and conveying operation.

The screening unit 78 is shown removed from the rest of the apparatus in FIG. 5, and is shown installed on the auger apparatus in an operational position in FIGS. 1 and 2. The unit 78 features a screen 79 made of a sheet or panel of metal grating or mesh, or similar perforated or opening-equipped material. The sheet provides sufficient strength to support a load of fertilizer or other granular particulate material atop the screen, while having suitably sized perforations or openings therein to allow grains of a predetermined maximum size or smaller to fall through the screen. In the illustrated embodiment, in which the open upper end of the inlet hopper is rectangular, the screen is rectangular in shape. However, other hopper and screen shapes may alternatively be used.

The screen 79 is fixed to a set of three perimeter members 80, 82, 84 that match up to three corresponding ones of the perimeter members 44, 48, 50 of the screen support frame 42. The three perimeter members of the screening unit 78 thus respectively lie along two longitudinal sides and one transverse end of the screen. Two side perimeter members 80, 82 lie parallel to one another and parallel to the longitudinal axis of the auger housing 12 when the screen unit is placed in the operational position atop the support frame 42 for use. The end perimeter member 84 of the screening unit perpendicularly connects to the two side perimeter members 80, 82 at an end thereof.

Each perimeter member of the screening unit is formed of a length of angle-iron. One leg of the angle-iron's right angle cross section lies parallel to the plane of the screen 79, and the other leg projects perpendicularly away from an underside of the screen that faces downwardly into the inlet hopper when the screening unit is installed. The screen 79 is attached to the perimeter members at the legs thereof that lie parallel to the screen, for example by welding or suitable fasteners. The other leg of each perimeter member extends from the first leg at the edge thereof that lies farthest outward from the center of the screen.

As best shown in FIG. 2, the screening unit additionally features a length of skirting 86 that runs along the same three sides of the screen perimeter as the perimeter members, but on the topside of the screen. The skirting projects upward from the screen at an oblique angle relative thereto so as to slope outwardly away from the center of the screen. The skirting may be made of a flexible material such as rubber or canvas, although a skirt of more rigid material or form is also within the scope of the present invention. The illustrated skirt is formed of a continuous run of flexible material spanning all three skirted sides of the screen's perimeter, but multiple skirting pieces spanning respective portions of the screen perimeter may alternatively be employed.

The screening unit 78 is installed by seating the screen, or the legs of the perimeter members 80, 82, 84 that are parallel to the plane of the screen, atop the upper surfaces of the respective perimeter members 44, 48, 50 of the screen support frame 42. With the screening unit so seated, the downward depending legs of the perimeter members 80, 82, 84 of the screening unit hang downwardly over the outside faces of the support frame perimeter members 44, 48, 50 at positions lying closely parallel to these outside faces. Accordingly, the downward-hanging leg of each angle iron perimeter member of the screen unit forms a stop flange that blocks relative sliding of the screening unit toward an opposing side of the inlet hopper perimeter. As a result, no fasteners, clamps or other securing means separate from the screening unit itself need to be used to secure the screening unit in place atop the support frame 42. The stop flange 80*a* of the end perimeter member 80 stops sliding of the screening unit relative to the support frame 42 in a longitudinal direction away from the oscillatory drive mechanism 60, while the stop flanges 82*a*, 84*a* of the side perimeter members 82, 84 block relative sliding of the screen unit relative to the support frame 42 in transverse or lateral directions.

Figure 6:
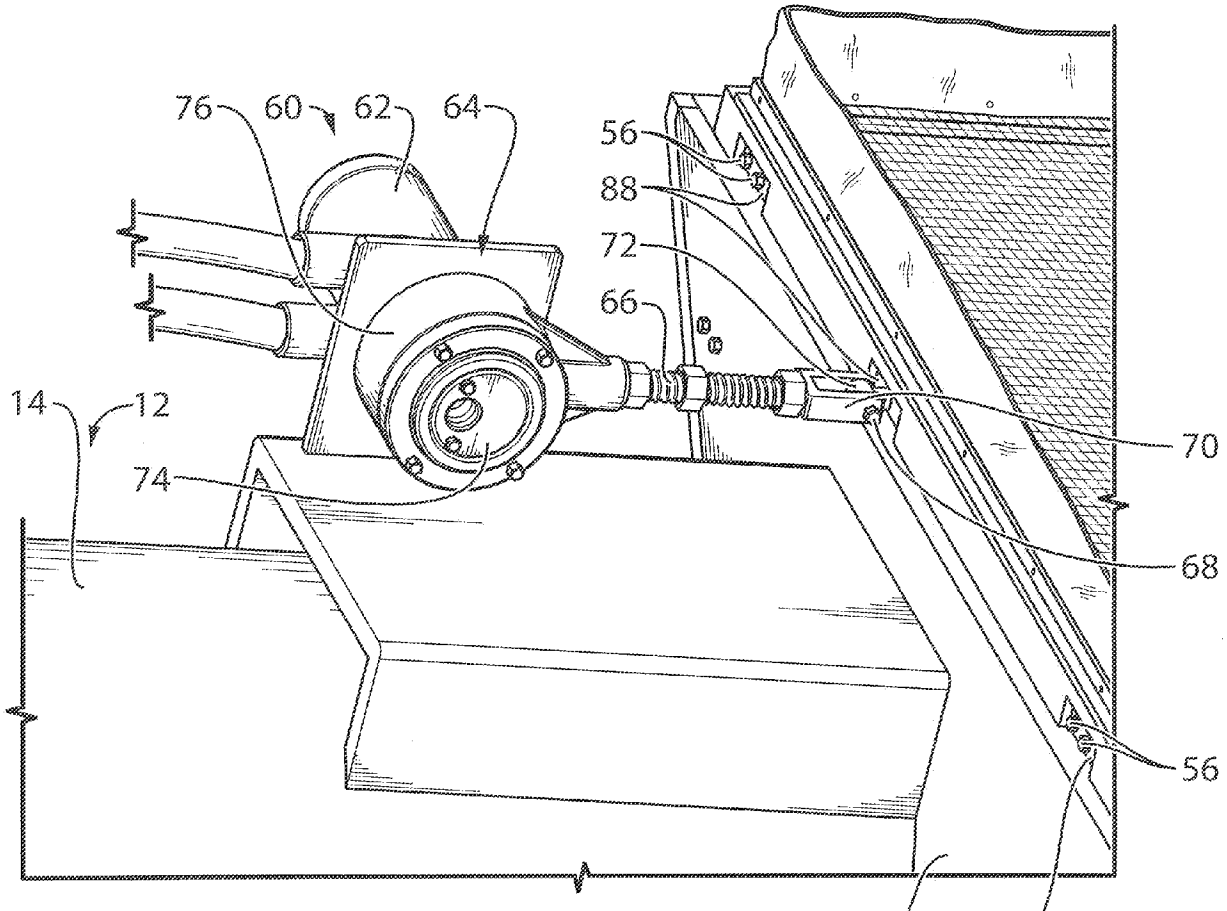
FIG. 6 shows a closeup side elevational view of an oscillatory drive mechanism coupled to the support frame to drive oscillatory motion of the screening unit seated atop the same.
Figure 7:
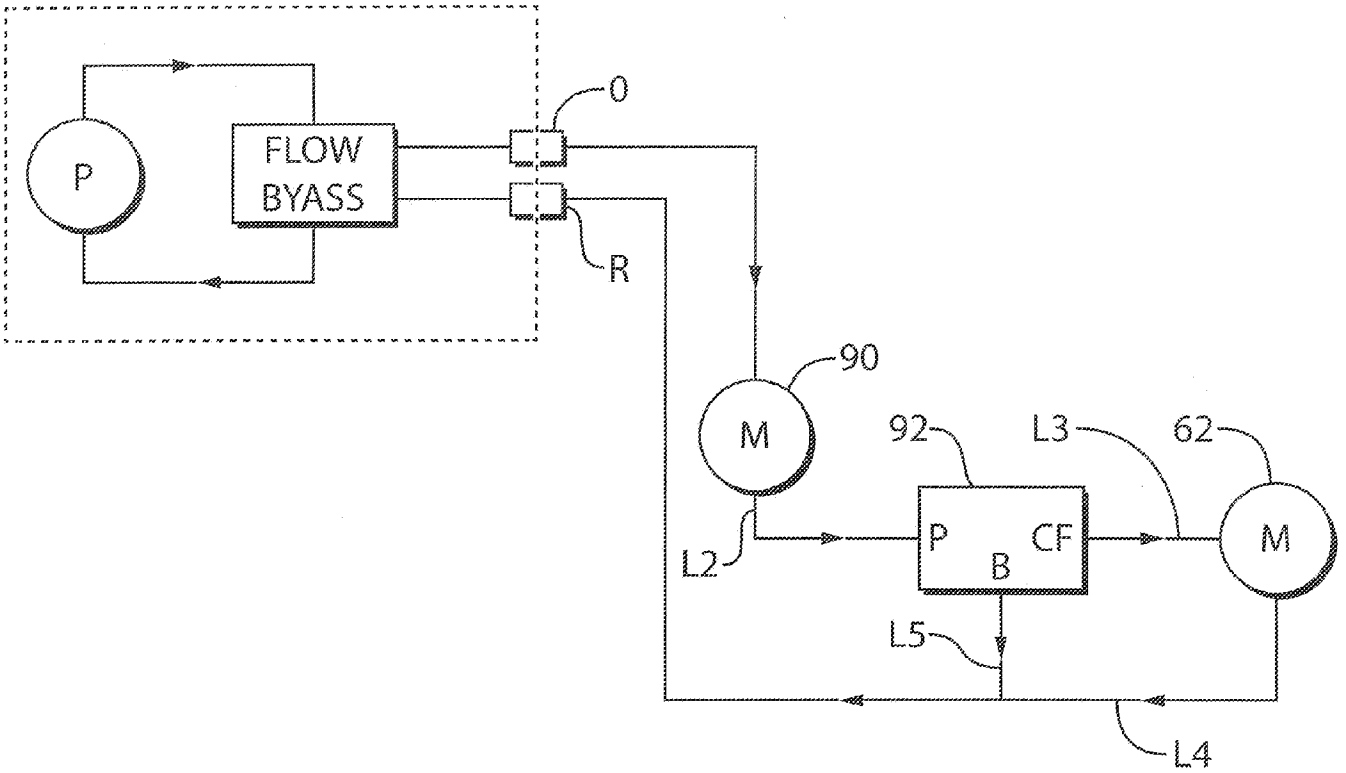
FIG. 7 is a schematic illustration of a hydraulic circuit for powering and controlling the hydraulic motors of the apparatus.

As shown in the drawings, the skirting may be riveted or otherwise fastened to a set of three angle irons fixed respectively atop the perimeter members of the screening unit. Each such skirt-supporting angle iron lies parallel to the underlying perimeter member 80, 82, 84, with one leg of the skirt-supporting angle iron fixed flush to the screen-supporting leg of the respective perimeter member and the other leg of the skirt-supporting angle iron standing upright therefrom in a plane parallel to the downward depending leg of the perimeter member. The upstanding leg of these angle irons forms a fastening flange, and the skirting 86 is fastened to the inside of this fastening flange around the three perimeter sides of the screen. FIG. 6 best illustrates one of the skirt-supporting angle irons.

In the illustrated embodiments, a fourth perimeter member is omitted from the screening unit since a stop flange is unnecessary at the end of the screen furthest from the oscillatory drive mechanism due to an inclined orientation of the auger housing which places the inlet end thereof lower than the opposing outlet end thereof. As a result, the screening unit is gravity biased in a longitudinal direction moving from the outlet end to the inlet end so as to default into a position in which the stop flange 80*a* of the of the end perimeter member of the screening unit abuts against the respective perimeter member 40 of the support frame 40. Therefore, no stop flange is required to limit movement of the screen relative to the support frame in the opposing longitudinal direction. However, inclusion of an additional perimeter member on the screen unit would still be within the scope of the present invention. With reference to FIGS. 5 and 6, a series of cutouts 88 are provided in the stop flange 80*a* of the end perimeter member 80 of the screening unit in order to accommodate the bolts 56 that attach the connecting plates 52 to the end perimeter member 40 of the support unit, and to accommodate the lug 72 of the support frame that forms the pivotal connection thereof to the output arm 66 of the eccentric drive mechanism.

While the illustrated embodiment employs stop flanges on the screening unit that hang down over the sides of the support frame 42, other embodiments may have upward projecting stop flanges on the support frame that abut against sides of the perimeter members of the screening unit. Also, each stop flange need not necessarily lie to the outside of the member against which it abuts in order to provide the movement blocking stop function, and instead may lie internally of that member.

With reference to FIG. 1, a second hydraulic motor 90 is mounted externally at the outlet end of the auger housing with its rotational output shaft coupled to the auger shaft 38 inside the housing in order to drive rotation of the auger 36. The two hydraulic motors are installed in the same hydraulic circuit as one another so as to share a common hydraulic power source, such as a hydraulic pump of an agricultural tractor, for driving both the auger and the oscillatory screen. A control valve 92 mounted on the auger housing at a location between the two hydraulic motors is connected to hydraulic lines or hoses of the circuit in a manner by which manipulation of the valve can be used to control the splitting of hydraulic fluid flow from the power source to the two hydraulic motors of the apparatus in order to adjust the oscillation speed of the screening unit and the rotational speed of the auger.

Figure 8:
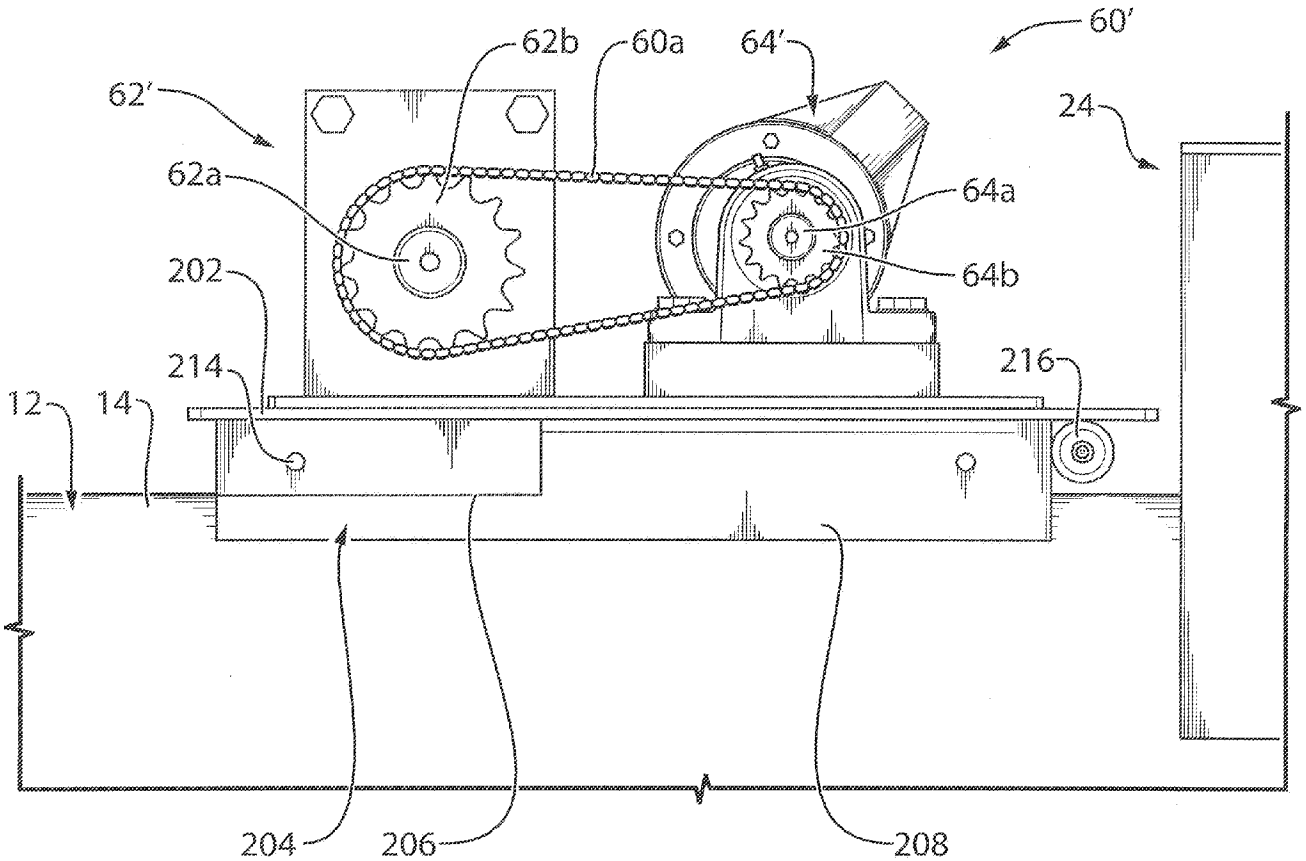
FIG. 8 is a partial side view of a second embodiment auger conveyor and screening apparatus, in which the oscillatory drive mechanism is removably mounted to the auger housing, whereby the same drive mechanism can be used on different conveyors.

FIG. 8 schematically shows a hydraulic circuit in which the combined screening and conveying apparatus of the present invention uses the existing pump P of a separate main auger unit as a power source. This demonstrates use of the apparatus of the present invention as a transfer auger to feed the inlet of the larger main auger. This is of course only one example of potential applications for the present invention, and other situations may employ an existing pump of another piece of equipment, or may feature a dedicated onboard pump on the combined auger and screening apparatus of the present invention.

A first hydraulic line L1 connects an output coupler O on the main auger to the flighting motor 90 of the transfer auger of the present invention, from which a second hydraulic line L2 connects to the control valve 92. An output flow control port on the valve 92 connects to the motor 62 of the oscillatory drive mechanism 60 of the transfer auger via a third hydraulic line L3, from which a return line L4 connects back to the main auger pump circuit at a return coupler R thereof. A bypass line L5 connects a bypass port of the control valve 92 to the return line L4 at an intermediate point between the oscillatory drive motor 62 and the return coupler R. An actuator on the control valve is manually or otherwise operable to control the division of flow between the flow control line L3 and the bypass line L5, thereby determining the ratio of fluid sent to the oscillatory drive motor 62 versus the fluid that bypasses that motor 62. With the control valve and oscillatory drive motor 62 situated downstream of the flighting motor 90 and in series with same, the speed of the oscillatory drive mechanism 60, and the screen driven thereby, is adjustable relative to the rotational speed of the auger flighting, thereby allowing adjustment of the screen speed independently of the auger speed.

Turning back to FIG. 1, to support the apparatus on the ground and allow wheeled transport of the same from one location to another, a ground wheel assembly 94 features an axle tube 96 on which a pair of ground wheels 98 are rotatably carried at opposing ends thereof. A pair of parallel connecting links 100 each have one end attached to the axle tube and the other end pivotally attached to the tubular portion 14 of the auger housing at an intermediate location between the inlet and outlet ends thereof. The connecting links 100 are pivotal about a shared horizontal transverse pivot axis at their connection to the auger housing, whereby the axle tube 96 is movable relative to the auger housing on an arcuate path about this pivot axis. Through such movement, the vertical height between the rotational axes of the wheels 98 and the pivot axis defined between the connecting links and the auger housing can be adjusted, thereby changing the height at which the intermediate tubular portion of the auger housing is located relative to the ground surface on which the ground wheels reside.

With the inlet end of the auger housing under the inlet hopper sitting on the ground, this height adjustment of the intermediate portion 14 of the auger housing 12 thus changes the angle of inclination of the auger housing relative to the ground. This not only adjusts the height of the outlet end of the auger housing, but additionally sets the inclination angle of the screen of the screening unit relative to the ground. Increasing the inclination angle of the auger housing raises the outlet end of the auger housing, and causes a matching increase of the inclination angle of the screen and lifts the end of the screen that is nearest the outlet end of the auger housing. Decreasing the inclination angle of the auger housing lowers the outlet end of the auger housing, and causes a matching decrease of the inclination angle of the screen and lowers the end of the screen that is nearest the outlet end of the auger housing.

A mechanism is provided to adjust the wheel position relative to the auger position, and thereby adjust the inclination angle of the auger housing and the screen carried thereon. This angle adjustment mechanism features an adjustment link 102 that has a first end thereof pivotally coupled to the axle tube, and a second end pivotally coupled to a slide collar 104 that engages around a slide rail 106. The slide rail 106 runs along the underside of the auger housing in the longitudinal direction thereof from at or near the discharge chute 22 toward the intermediate location on the auger housing at which the connecting links 100 are coupled to the auger housing.

The pivot points between the slide collar and the adjustment link, between the adjustment link and the axle tube, and between the connecting links and the auger housing all have parallel pivot axes to so as to define a working slide linkage. Accordingly, sliding of the collar 104 along the slide rail 106 causes the axle tube, and thus the ground wheels coupled thereto, to swing about the pivot axis of the connecting links. A set screw, clamp, pin or other locking device is used to lock the slide collar 104 in place any one of a number of different possible positions along the slide rail 106, thereby locking the ground wheels in a selected position relative to the auger housing. A maximum inclination angle of the auger housing and screen is accomplished by movement of the slide collar into a position that places the connecting links in a vertical orientation that maximizes the difference in elevation between the wheel axes and the pivotal coupling of the connecting links to the auger housing. Subsequent sliding of the slide collar toward the elevated outlet end of the auger housing pulls the ground wheels toward the outlet end, thereby swinging the connecting links into an oblique orientation thus lowering the outlet end of the auger housing and reducing the inclination angle of the auger housing and screen.

Having described the overall structure of the apparatus and the operation of its sub-components, an exemplary use of the apparatus is now described. With the screening unit installed on the support frame, the apparatus is wheeled into a position placing the inlet hopper and screening device beneath the bottom outlet of a granular fertilizer storage bin. A hydraulic power source coupled to the two motors of the apparatus is activated in order to start driving the rotation of the auger and the oscillatory or vibrational movement of the screening unit. The storage bin outlet is opened, allowing granular fertilizer onto the screen, and the openings in the screen limit the size of material than can fall through the screen and into the inlet hopper for entry to the auger housing. The screened material that successfully passes through the screen and into the auger housing is conveyed up to the outlet of the auger housing, from which the conveyed material falls into a recipient container, for example into the fertilizer hopper of an air seeder or into the inlet hopper of a larger second auger that used to further convey the material to a greater elevation than that which is achievable with the screening auger.

The skirting on the three sides of the screen prevents or limits falling of the granular fertilizer from these sides of the screen, while the lowermost unskirted fourth side of the screen remains open in order to allow the filtered-out material (i.e. that which is too large to pass through the screen) to gravitationally discharge itself from this lowermost end of the inclined screen. A catch pan may be positioned below this lower end of the screen, or to this end of the screening unit, so as to catch the filtered-out material that fell from screen in order to avoid the need to later clean the filtered-out material from the ground after the screening and conveying process is completed.

The more aggressive the inclination angle of the screen, the shorter amount of time the material introduced onto the screen will reside on the same. Accordingly, without changing screens, the inclination angle can be used to adjust the screening operation. Use of a steep angle will give material less time on the screen, thus reducing the amount of material that will successfully pass through the screen and into the auger. A smaller angle will increase the available time for the vibrational action of the screen to breakup a given clump of material, and will increase the likelihood that a piece of material closely matching the opening-size of screen will eventually align itself with an opening and fall through the same before falling from the lower end of the screen.

In addition to the angular adjustment to modify the screening performance, the removable nature of the screening unit allows units of different screen characteristics to be simply swapped out for one another according to the needs of a particular screening operation. For example, an operator may use one screening unit to convey one type of granular material, and then remove the first screening unit and substitute it for another screen of different mesh-size for use in screening and conveying of a different material. The screening unit of the illustrated provides a simple tool-less installation process by which the screen unit is simply seated in place atop the support frame without need for any tool-driven or manually operated securing fasteners or hold-down mechanisms, and the screen can be removed just as simply by just manually lifting the screening unit from off the support frame. The easy removal and installation of the screen not only enables simple screen substitution to address the needs for different screening jobs, but also allows convenient use of the apparatus without any screening unit for use in a pure conveyance context where no screening of the conveyed material is required. In such a situation, the control valve can be used to fully close off the hydraulic fluid delivery to the oscillatory screen-drive mechanism so that only the auger motor is driven by the connected hydraulic source.

The disclosed embodiments describe a transfer auger that has a screening unit or scalping deck on the top which can be used to screen the contaminants out of fertilizer and keep them out of seeding equipment. The Screening deck is hydraulically speed controlled, as is the auger flighting, which is preferably centered in the auger tube and supported at both ends for quiet, vibration free operation. The apparatus may be offered with different auger sizes, for example 8-inch and 10-inch models. The screening deck of the illustrated embodiment is driven by an eccentric bearing, but other modes of driving oscillation/vibration of the screen via the support frame may be employed. The screening deck is mounted on a corrosion resistant hanging system, wherein the flexible deflecting connection plates between the support frame and hopper result in a design requiring no bearings or other moving parts that are susceptible to corrosion problems.

The screening deck is removable without tools and the machine, meaning that screen sizes can easily be changed and that the apparatus can be used as a regular screen-less transfer auger, thereby making it useful for more than one application. Different screen sizes are preferably made available to the consumer. Although the illustrated embodiment was built to run hydraulically, other embodiments may be driven electrically or by combustion engine (e.g. gasoline engine). When the apparatus is used as a transfer auger to feed a larger main auger, the apparatus can be powered the from main auger hydraulic system, for example via connections that have previously been used to power other hydraulic accessories, such as hydraulic wheel drive systems.

The wheeled unit is portable, and the auger flighting may be removable in a manner similar to known removable-flighting auger solutions, for example by employing a ring of bolts by which the entire auger drive motor and flighting can be slid out of and off of the housing. The hydraulically powered eccentric bearing assembly may be mounted to the auger housing in a removable manner to allow use of the same oscillatory drive mechanism for other applications. The auger height adjustment doubles as a screen height adjustment for controlling the inclination angle of both.

FIG. 8 shows a second embodiment featuring the same arrangement of auger, inlet hopper, screen support frame and screen unit as the first embodiment, but adds a releasable mounting arrangement 200 for removably supporting the oscillatory drive mechanism 60' on the auger housing. This way, the drive mechanism 60' can be selectively detached from one auger, and installed on another other conveyor. The other conveyor may be another auger-type conveyor, or may be a different conveyor type, such as a belt conveyor. This way, a single owner or operator of multiple conveyors can save on costs by purchasing multiple screen support frames (i.e. one for each conveyor), and purchasing only a single drive mechanism that can be interchanged back and forth between the different conveyors. If the inlet hoppers and screen support frames are the same size, then the user can also use the same screen unit on the different conveyors.

With continued reference to FIG. 8, the hydraulic motor 62 and eccentric bearing assembly 64 are affixed to the topside a of base plate 202, the underside of which is seated atop a mounting seat 204 that is affixed to the auger housing 12 at a short distance from the inlet hopper 24. In the second embodiment, the eccentric bearing assembly is not in a direct drive configuration directly attached to the output shaft of the motor. Instead, an input shaft 64*a* of the eccentric bearing assembly and the output shaft 62*a* of the motor each have a respective gear 64*b*, 62*b* keyed thereon, and a drive chain 60*a* is entrained around the gears 62*b*, 64*b* in order to drive the eccentric bearing assembly under operation of the motor. The motor 62 is therefore situated behind the eccentric bearing assembly 64, i.e. on the side of the eccentric bearing assembly opposite the inlet hopper so as to reside between the eccentric bearing assembly and the outlet end of the auger housing. However, a direct drive arrangement like that of the first embodiment, or a different type of indirect drive arrangement, may be alternatively be employed without affecting the functionality of the releaseable mounting arrangement 200.

A pair of flanges 206 project perpendicularly downward from the underside of the base plate 202 at positions spaced apart from one another in a horizontal transverse direction that is perpendicular to the longitudinal axis of the auger. The mounting seat 204 features a pair of side walls 208 each standing upright from the topside of the auger housing 12 on a respective side of a vertical midplane of the auger housing that contains the longitudinal axis of the auger. Each side wall 208 of the mounting seat 204 resides in a vertical plane parallel to those of the base plate flanges 206, with each side wall 208 residing a short distance inwardly toward the midplane of the auger housing from the plane of the respective flange 206. This way, each flange 206 of the base plate 202 depends downwardly over the respective side wall 208 of the mounting seat 204 when the base plate 202 is in a seated position on the mounting seat. In the seated position, the base plate 204 rests flush against a top plate 210 of the mounting seat that spans between the two side walls 208 at the top edges thereof. With the base plate 202 seated atop the mounting seat 204, a through-hole 212 in each flange 206 of the base plate 202 aligns with a corresponding through-hole 214 in the respective side wall 208.

Figure 9:
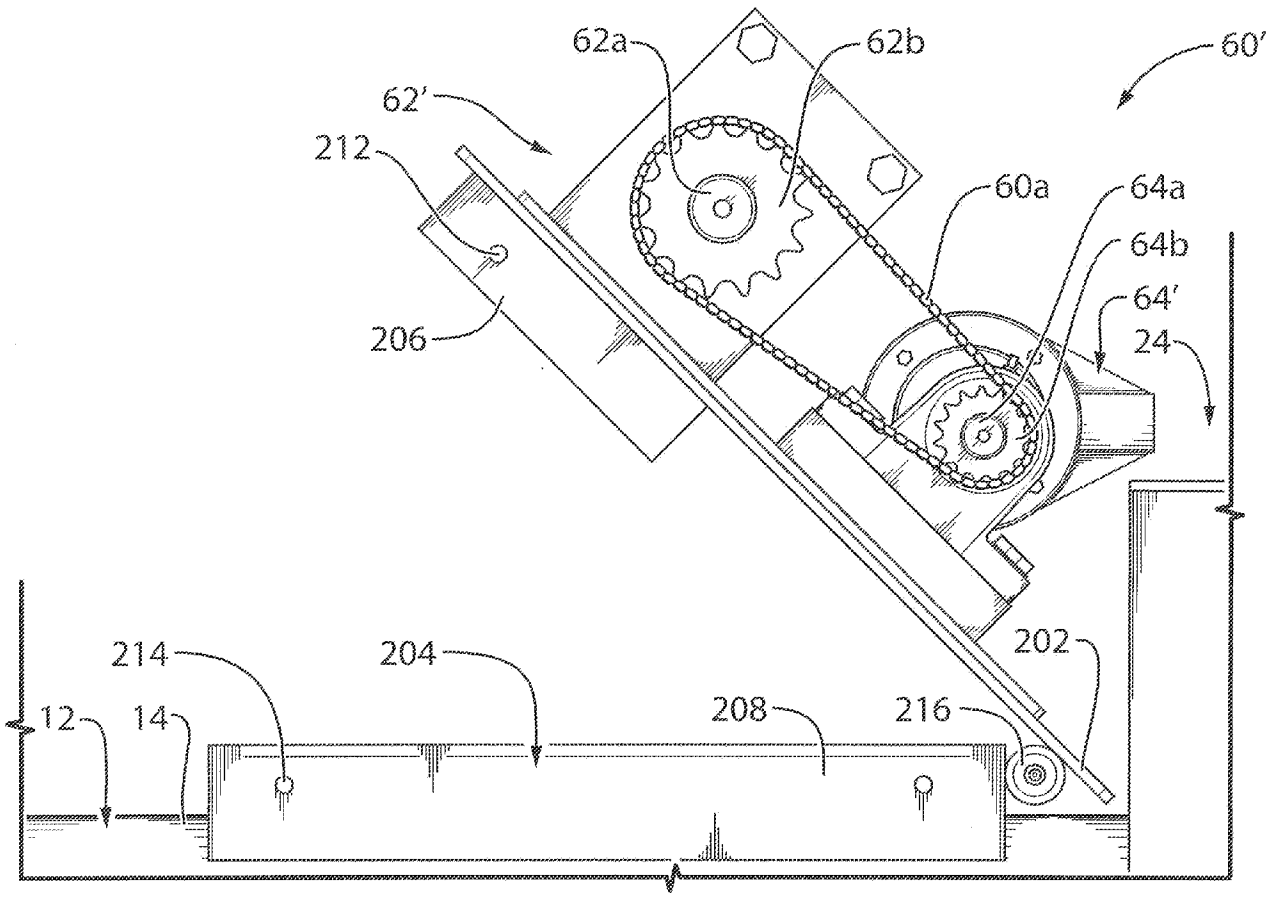
FIG. 9 is a partial side view of the removable drive mechanism of FIG. 8, illustrating disconnection of a pinned connection between a base plate of the drive mechanism and a mounting seat affixed to the auger housing.

With reference to FIG. 9, a hinge joint 216 is defined between the base plate 202 and the mounting seat 204 at one end thereof to enable pivoting of the base plate about a horizontal transverse axis lying perpendicular to the longitudinal axis of the auger. When the base plate 204 is seated atop the mounting seat 204, as shown in FIG. 8, the aligned holes 12, 14 at each side of the mounting base align with those on the other side, whereby a locking pin 218 can be passed through these four aligned holes to prevent pivoting of the base plate 202 relative to the mounting seat 204 about the axis of the hinge joint 216.

Figure 10:
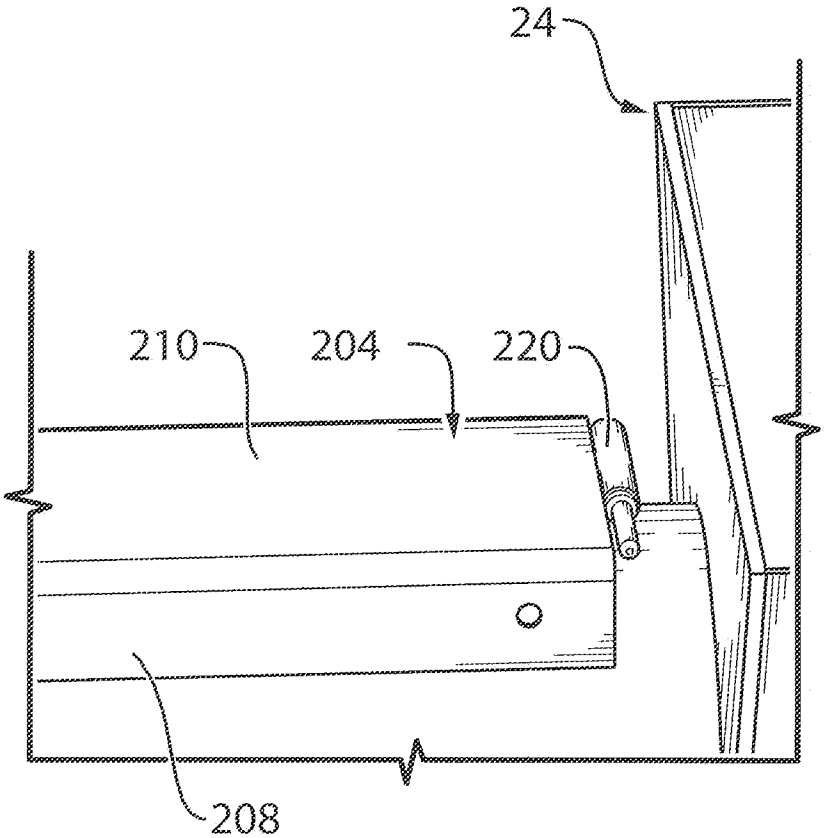
FIG. 10 is a partial perspective view of the mounting seat, illustrating half of a disconnectable hinge joint that is defined between the base plate and the mounting seat at an end thereof located distally of the pinned connection.
Figure 11:
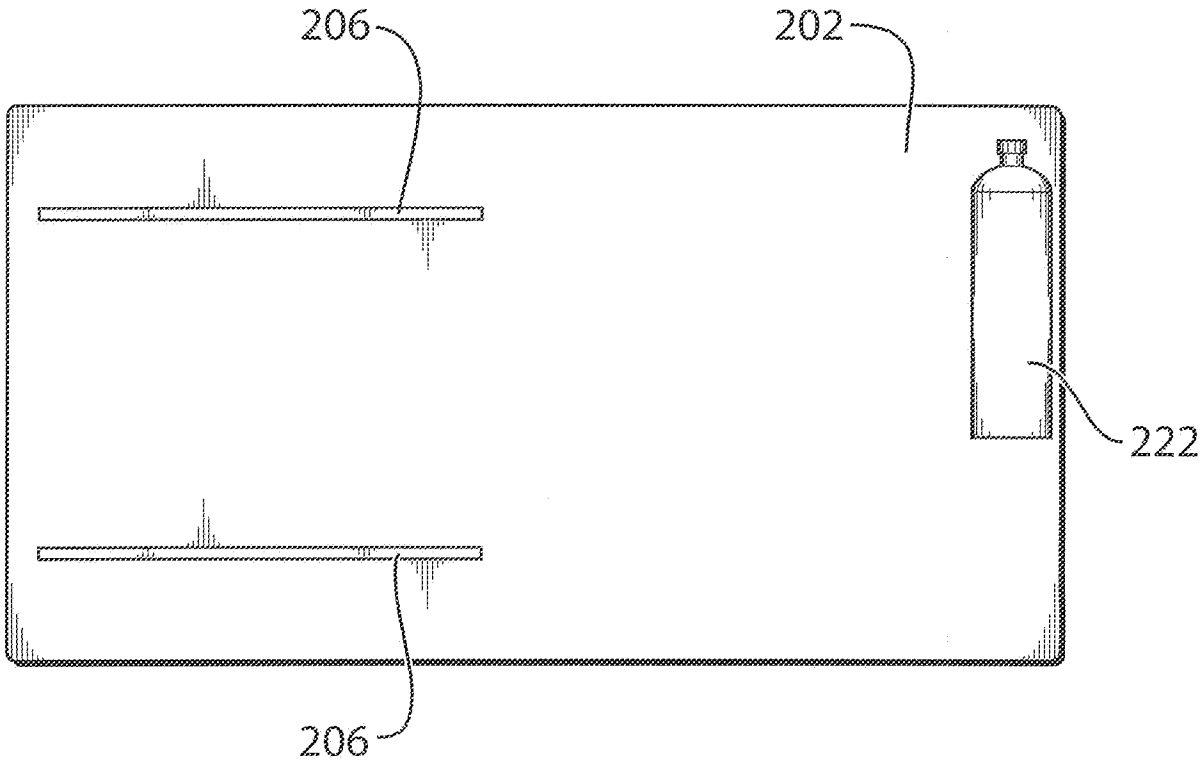
FIG. 11 is an underside view of the base plate of the drive mechanism, illustrating a second half of the disconnectable hinge joint.

The hinge joint 216 features a male half 220 fixed to the mounting seat at the end thereof, as shown in FIG. 10, and a female half 222 fixed to the underside of the base panel 202, as shown in FIG. 11. The male half features a shaft that fits into a hollow cylindrical form of the female half 222 in a manner allowing rotation of the female half about the shaft of the male half, whereby the shared axes of these concentric members defines the transverse pivot axis between the mounting seat and the base plate 202.

To remove the drive mechanism 60' from the auger housing 12, first the user removes the bolt or pin 68 (FIG. 4) to disconnect the output arm 66 of the eccentric bearing assembly from the screen support frame, and removes the locking pin 218 from the aligned holes of the mounting seat and base plate flanges. With the locking pin 218 removed, the base plate 202 is pivoted upwardly off the topside of the mounting seat until the base plate flanges 206 are withdrawn entirely clear of the side walls of the mounting seat. With the base plate pivoted up into this tilted orientation off the mounting seat, the base plate is pulled laterally outward from the auger housing in a direction sliding the female half of the hinge joint off of the male half, thereby freeing the base plate and the attached flanges, motor and bearing assembly from the auger housing.

The removed drive assembly can be reinstalled on the same conveyor, or installed on a different conveyor featuring the same mounting seat configuration, by sliding the female half of the hinge joint onto the male half thereof while the base plate is in the tilted orientation relative to the topside of the mounting seat, then lowering the tilted base plate down into a seated position flat atop the mounting seat, then inserting the locking pin into the aligned holes in the base plate flanges and mounting seat to lock down the base plate, and then connecting the output arm 66 of the eccentric bearing assembly 64 to the screen support frame.

In the illustrated embodiment, the base plate and mounting seat are hinged together at the ends thereof nearest the inlet hopper, are releasably lockable by the pinned connection near the other end distal thereto. It will be appreciated however that the hinged and locking ends may be reversed. Also, passage of the locking pin through both mounting seat side walls and both base plate flanges is not necessarily required, and pinned connection at only one side of the releasable mounting arrangement may be sufficient to secure the base plate and drive mechanism in place.

Figure 12:
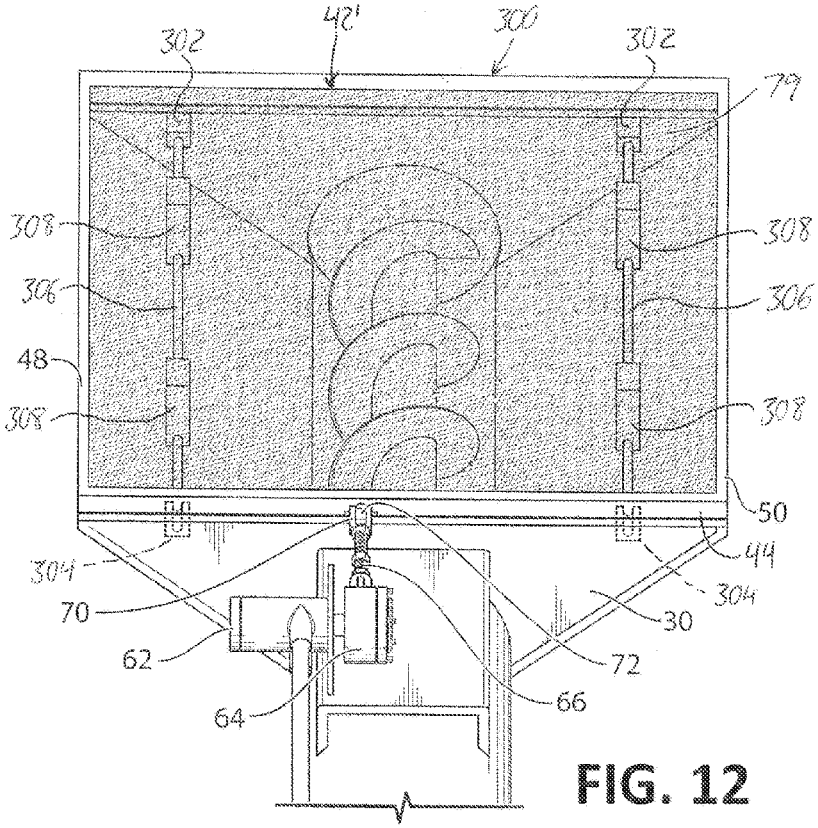
FIG. 12 is a partial perspective view of a third embodiment auger conveyor and screening apparatus.
Figure 12A:
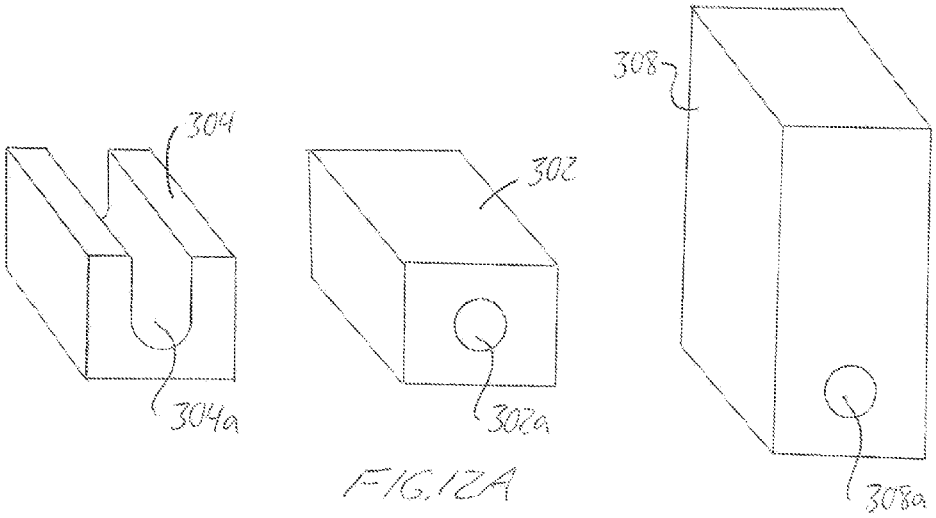
FIG. 12A is a perspective view of support and slider blocks used in the third embodiment to form a linear bearing assembly for support of an oscillating screen assembly of the auger conveyor and screening apparatus.

FIG. 12 shows a third embodiment in which instead of a removable screening unit 78 seated atop a permanently mounted support frame 42, the support frame 42' is removably supported on the inlet hopper 24, and the screen 79 is permanently affixed to the support frame 42' to form a screen and support frame assembly 300. The skirting is omitted for ease of illustration, but is preferably included in such embodiments. At one of the hopper end walls 30, at or near the open top end of the hopper, a first pair of support blocks or bushings 302 are affixed to the inside surface of the end wall 30, and each feature an cylindrical opening 302*a* extending into the block from an thereof lying opposite the end wall 30 in an axial direction toward the end wall 30.

At the other end wall 32 of the hopper, a second pair of support blocks or bushings 304 (shown in broken lines) are affixed to the inside surface of the end wall 30, and each feature an cylindrical opening extending into the block from an thereof lying opposite the end wall 30 in an axial direction toward the end wall 30. Each second block 304 has a U-shaped channel running axially thereinto from the end thereof opposite the end wall 30, whereby the top end of the block 304 is open, and the bottom of the U-shaped channel forms a cradle for cooperating with a respective one of the first support blocks 304 to support a respective guide shaft 306 in a suspended position at or near the open top end of the hopper.

Each guide shaft 306 passes through two or more slider blocks 308 that are affixed to the screen and support frame assembly 300. In the illustrated embodiment, where the support frame 42' overlies the perimeter edges of the top end of the hopper, the slider blocks 306 are affixed to the underside of the screen 79. In other embodiments, the perimeter the support frame 42' may be sized so as to be slightly smaller than the open top end of the hopper so that the slider blocks 308 are instead affixed to the underside of the support frame 42'. Each slider block is axially slidable back and forth along the respective guide shaft 306.

To install the removable support frame and screen assembly 300, the ends of the two guide shafts 306 at one end of the screen are inserted into the axial openings at the inner ends of the first support blocks 302, and then the other ends of the two guide shafts 306 are laid down into the U-shaped cradle channels of the second support blocks 304 at the opposing end of the hopper. The output arm 66 of the eccentric bearing assembly 64 is then coupled to the end member 44 of the support frame 42' using bolt or pin 68, which may be a quick release pin for easy installation and removal of the support frame and screen assembly 300. The two slider blocks 308 on each guide shaft 306 are axially slidable back and forth therealong in order to enable the oscillation of the support frame 42' and screen 79 under operation of the drive mechanism 60', and to constrain the motion thereof to the linear path defined by the pair of parallel guide shafts 306 lying longitudinally of the inlet hopper near the open top end thereof.

The slider blocks 308 may be made of low friction material, coated with a low friction coating or lubricant at the cylindrical through-bores 308*a* thereof that receive the guide shafts 306, or incorporate bearings or bushings at this sliding interface. Also, the term block is not intended to denote a specific shape or structure of these sliding blocks 308, which accordingly may also be referred to more generally as slide members. The slide members and guide shafts effectively form a linear bearing mechanism by which the removable support frame and screen assembly is supported for oscillation by the drive mechanism. The assembly is easily installed and removed without the use of tools by inserting and laying the guide shafts in the support blocks for installation, and withdrawing and lifting the guide shafts out of the support blocks for removal. The only permanent installation is the mounting blocks. Together with the removable drive mechanism of the second embodiment, the support frame and screen assembly can be swapped between different conveyors.

Figure 12B:
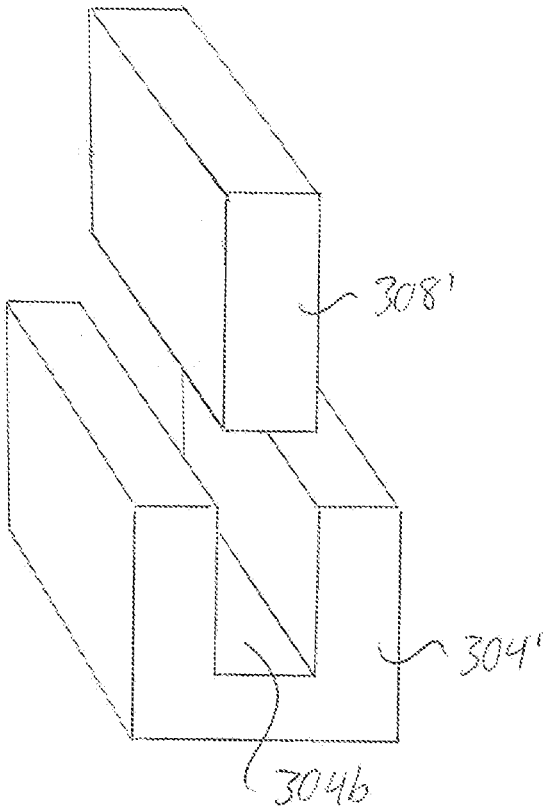
FIG. 12B is a perspective view of support and slider blocks used in the third embodiment to form a linear bearing assembly for support of an oscillating screen assembly of the auger conveyor and screening apparatus.

FIG. 12B shows an alternate linear bearing solution which uses the same type of support block 304' at both ends of the hopper, and a slide block 308'. The support block 304' fixed to the hopper wall features a rectangular channel or slot running axially therethrough that is open at the top of the support block, and the slide block 308 is slidably disposed within the channel of the support block 304'. This embodiment uses the channel in the support block as the guide on which the slide blocks 308 slide, instead of relying on a separate guide shaft seated on the support blocks. Again, the term block is not intended to denote a specific shape, and so the support blocks may simply be referred to as frame supports, which support the support frame of the screen, either directly through built-in guide features or indirectly through separate guide shafts or members.

Since various modifications can be made in my invention as herein above described, and many apparently widely different embodiments of same made within the scope of the claims departure from such scope, it is intended that all matter contained in the accompanying specification shall be interpreted as illustrative only and not in a limiting sense.

The invention claimed is:

1. A combined conveyor and screening apparatus comprising:

a housing having opposing inlet and outlet ends spaced apart along a longitudinal dimension of the housing;

a conveyor residing in a position running longitudinally of the housing between the inlet and outlet ends thereof;

an inlet hopper mounted to the housing adjacent the inlet end thereof with an open lower end of the inlet hopper opening into the housing for feeding of the conveyor from said inlet hopper;

a screen;

a screen support frame disposed atop the inlet hopper, the screen support frame supporting, or being arranged to support, the screen in a position overlying an area of the inlet hopper; and a screen drive mechanism coupled to, or arranged for coupling to, the screen support frame and operable to drive oscillatory motion of the screen support frame relative to the inlet hopper and the housing;

wherein the screen is part of a screening unit that is configured for fastener free seating of the screening unit in an operable position engaged with the screen support frame, and the screening unit comprises downturned flanges defined on respective sides of a perimeter of the screening unit.

2. The apparatus of claim 1 wherein the downturned flanges are defined by downwardly depending legs of angle-iron perimeter members of the screening unit, other legs of which receive edge-adjacent portions of a perforated sheet defining the screen of the screening unit.

3. The apparatus of claim 1 wherein the screen drive mechanism is driven by a first hydraulic motor, a second hydraulic motor is operably coupled to the conveyor for driven operation thereof, and the first and second hydraulic motors are arranged for operation thereof by a common hydraulic power source.

4. The apparatus of claim 3 wherein the screen drive mechanism comprises an eccentric bearing assembly driven by the first hydraulic motor and having an output arm attached to the screen support frame.

5. The apparatus of claim 3 comprising a control valve installed in a hydraulic circuit of the first and second hydraulic motors and operable to adjust an oscillatory speed of the screen support frame.

6. The apparatus of claim 1 comprising skirting projecting upward from the screen adjacent a perimeter of said screen.

7. The apparatus of claim 6 wherein the skirting spans only a partial portion of the perimeter of said screen, leaving an unskirted portion of the perimeter of said screen at an end thereof opposite the outlet end of the housing.

8. The apparatus of claim 7 wherein the unskirted portion of the perimeter of the screen fully spans a width of the screen at the end thereof opposite the outlet end of the housing.

9. That apparatus of claim 1 wherein the screen drive mechanism is mounted atop the housing at a location between the inlet hopper and the outlet end of the housing.

10. The apparatus of claim 1 wherein the screen drive mechanism is removably mounted to the housing.

11. The apparatus of claim 10 comprising a mounting seat affixed to the housing, and a releaseable connection between the screen driven mechanism and the base to enable removal and reattachment of the screen drive mechanism to the housing.

12. The apparatus of claim 11 wherein the releaseable connection comprises a pinned connection.

13. The apparatus of claim 11 wherein the drive mechanism is mounted on a base, which in turn is releasably coupled to the mounting seat by the releaseable connection.

14. The apparatus of claim 1 comprising an additional screening unit having a second screen that differs from the screen of the screening unit in at least one characteristic of the screen, the screening units being substitutable for one another atop the screen support frame.

15. A combined conveyor and screening apparatus comprising:

an housing having opposing inlet and outlet ends spaced apart along a longitudinal dimension of the housing;

a conveyor running longitudinally of the housing between the inlet and outlet ends thereof;

an inlet hopper mounted to the housing adjacent the inlet end thereof with an open lower end of the inlet hopper opening into the housing for feeding of the conveyor from said inlet hopper;

a screen carried on the housing and positioned to screen incoming material introduced into the housing through the inlet hopper;

a ground wheel assembly coupled to the housing and comprising a set of ground wheels for rolling transport of the housing over a ground surface; and an angle adjustment mechanism is operable to vary a position of the ground wheels relative to the housing in order to change an inclination angle of the housing and the screen relative to the ground surface on which the housing is supported;

wherein the ground wheel assembly comprises an axle member at opposite ends of which the ground wheels are rotatably supported and a connecting link having an upper end pivotally coupled to the housing and a lower end coupled to the axle member, and pivoting of the connecting link adjusts the inclination angle.

16. The apparatus of claim 15 wherein the angle adjustment mechanism comprises an adjustment link having one end pivotally coupled to the axle member and a second end pivotally coupled to a sliding link that is slidably mounted on a slide support on the housing for movement of the sliding link back and forth along the longitudinal dimension of the housing to pivot the connecting link in opposing directions to adjust the inclination angle.

17. The apparatus of claim 15 comprising skirting projecting upward from the screen adjacent a perimeter of said screen.

18. The apparatus of claim 17 wherein the skirting spans only a partial portion of the perimeter of said screen, leaving an unskirted portion of the perimeter of said screen at an end thereof opposite the outlet end of the housing.

19. The apparatus of claim 18 wherein the unskirted portion of the perimeter of the screen fully spans a width of the screen at the end thereof opposite the outlet end of the housing.

20. A combined conveyor and screening apparatus comprising:

a housing having opposing inlet and outlet ends spaced apart along a longitudinal dimension of the housing;

a conveyor running longitudinally of the housing between the inlet and outlet ends thereof;

an inlet hopper mounted to the housing adjacent the inlet end thereof with an open lower end of the inlet hopper opening into the housing for feeding of the conveyor from said inlet hopper;

a screen unit carried on the housing and comprising a screen positioned to screen incoming material introduced into the housing through the inlet hopper;

a first hydraulic motor operable to drive oscillatory motion of the screen unit relative to the inlet hopper and the housing;

a second hydraulic motor operably coupled to the conveyor for driven operation thereof;

wherein the first and second hydraulic motors are arranged for operation thereof by a common hydraulic power source.

21. The apparatus of claim 20 comprising a control valve installed in a hydraulic circuit of the first and second hydraulic motors and operable to adjust an oscillatory speed of the screen unit.

22. The apparatus of claim 20 comprising an eccentric bearing assembly driven by the first hydraulic motor and having an output arm thereof attached to the screen unit.

23. That apparatus of claim 20 wherein the first hydraulic motor is mounted atop the housing at a location between the inlet hopper and the outlet end of the housing.

24. That apparatus of claim 22 wherein the first hydraulic motor and the eccentric bearing assembly are mounted atop the housing at a location between the inlet hopper and the outlet end of the housing.

25. A combined conveyor and screening apparatus comprising:

a housing having opposing inlet and outlet ends spaced apart along a longitudinal dimension of the housing;

a conveyor residing in a position running longitudinally of the housing between the inlet and outlet ends thereof;

an inlet hopper mounted to the housing adjacent the inlet end thereof with an open lower end of the inlet hopper opening into the housing for feeding of the conveyor from said inlet hopper;

a screen;

a screen support frame disposed atop the inlet hopper, the screen support frame supporting, or being arranged to support, the screen in a position overlying an area of the inlet hopper; and a screen drive mechanism coupled to, or arranged for coupling to, the screen support frame and operable to drive oscillatory motion of the screen support frame relative to the inlet hopper and the housing; and strip-shaped deflectable connection plates having upper ends thereof attached to the screen support frame at opposing perimeter members thereof to carry said screen support frame atop the inlet hopper, the upper ends of the strip-shaped deflectable connection plates being deflectable back and forth relative to lower ends of said strip-shaped deflectable connection plates to enable the oscillatory motion of the screen support frame under operation of the screen drive mechanism.

* * * * *